US006412893B1

(12) United States Patent
Müterthies et al.

(10) Patent No.: US 6,412,893 B1
(45) Date of Patent: Jul. 2, 2002

(54) FASTENING ARRANGEMENT FOR PULL-OUT SLIDE

(75) Inventors: Ralf Müterthies, Löhne; Stefan Rüter, Bad Oeynhausen; Carsten Meyer, Bielefeld; Gerhard Schröder, Bad Oeynhausen; Jörg Aufderheide, Spenge; Eyyahi Dincdemir, Hiddenhausen; Rolf Mertes, Bad Salzuflen, all of (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 0 days.

(21) Appl. No.: 09/663,188

(22) Filed: Sep. 15, 2000

(30) Foreign Application Priority Data

Sep. 17, 1999 (DE) ..... 199 44 639

(51) Int. Cl.[7] ..... A47B 88/04
(52) U.S. Cl. ..... 312/348.1; 312/330.1
(58) Field of Search ..... 312/330.1, 334.1, 312/334.7, 334.14, 334.27, 348.1, 348.2, 348.4, 263

(56) References Cited

U.S. PATENT DOCUMENTS

| | | | | |
|---|---|---|---|---|
| 3,029,357 A | 4/1962 | Williams | ..... | 312/263 |
| 3,549,301 A | 12/1970 | Harris et al. | ..... | 312/330.1 |
| 3,729,246 A | 4/1973 | Harrell et al. | ..... | 312/330.1 |
| 5,197,791 A | 3/1993 | Domenig | ..... | 312/348.1 |
| 5,370,454 A | 12/1994 | Domenig | ..... | 312/342.1 |
| 5,433,518 A | 7/1995 | Skov | ..... | 312/348.1 |

FOREIGN PATENT DOCUMENTS

| | | | | |
|---|---|---|---|---|
| DE | G 73 17 344.1 | | 5/1973 | |
| DE | GM 79 00 396 | | 6/1980 | |
| DE | G 83 33 251.0 | | 3/1984 | |
| DE | 4016452 | | 9/1991 | |
| DE | G9311493.1 | | 11/1993 | |
| DE | G 94 07 813.0 | | 9/1994 | |
| DE | 19726466 | A1 | 12/1998 | |
| EP | 377113 | * | 7/1990 | ..... 312/330.1 |
| EP | 551575 | * | 7/1993 | ..... 312/348.2 |
| WO | 8901305 | * | 2/1989 | ..... 312/330.1 |

* cited by examiner

*Primary Examiner*—James O. Hansen
(74) *Attorney, Agent, or Firm*—Barnes & Thornburg

(57) ABSTRACT

A fastening arrangement for side walls of drawers, including several fastening elements connectable with a rail of a pull-out slide. Each fastening element provided with a holding part which extends essentially parallel to a side wall of the drawer. At least two receiving devices provided on each holding part for fastening side walls elements of the drawer to the fastening elements on the rail. The receiving devices are situated on opposite sides of the holding device. This construction permits varied configurations and designs, and allows one to adapt to the respective size and mechanical load of the drawer. The receiving devices are preferably formed between a project and an arm on the holding part, so that the side wall elements of the drawer can be clamped into the receiving devices.

13 Claims, 14 Drawing Sheets

13'
152
151
14'
151
15'
164
10'
161
16'
16'
163
11'
162

FASTENING ARRANGEMENT FOR PULL-OUT SLIDE

BACKGROUND AND SUMMARY OF THE INVENTION

The invention relates to a fastening arrangement used particularly for drawers in order to connect side wall elements of a drawer with a pull-out slide.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36770 |
| Müterthies, Rüter, et al. | Mounting Unit | 824/36772 |
| Müterthies, Rüter, et al. | Fastening Arrangement | 824/36773 |
| Müterthies, Rüter, et al. | Pull-out Slide Set | 824/36774 |
| Müterthies, Rüter, et al. | Partitioning System | 824/36775 |
| Müterthies, Rüter, et al. | Fastening Arrangement | 824/36785 |

The claims, drawings and specification of each of the foregoing applications is hereby specifically incorporated by reference into this specification as if set forth verbatim herein.

German Patent Document DE 93 11 493 U1 shows a drawer kit in which a drawer frame is connected on one side with a drawer bottom and on the other side with a rail of a pull-out slide. The drawer frame is constructed as a hollow profile, with an adapter supporting the side walls in the interior. The production of this type of drawer kit is costly because separate drawer frames must be produced for the right and left side of the drawer. In addition, a completely new production must be started for drawer frames of different sizes, which raises the manufacturing costs.

In addition, German Patent Document DE 40 16 452 A1 shows a drawer in which a side wall is formed of several profile parts in order to reinforce the side wall. In this case, a first side wall element is connected with the drawer bottom and, in addition, with the rail of a pull-out slide. Grooves are formed on this first side wall element so that a second rail-shaped side wall element can be pushed onto the first side wall element. Also in the case of this drawer, each side wall element is designed only for a certain type of drawer. It is not intended to vary with the height of the side wall according to the requirement or to adapt the fastening of the side wall to different load situations.

The present invention provides a fastening arrangement for side walls of drawers which can be flexibly adapted to different side wall sizes and shapes. The side wall elements are usable on the right as well as on the left side of the drawer. In addition, it should be possible to produce the fastening arrangement at reasonable cost.

This object is achieved by means of a fastening arrangement wherein each holding part of a fastening element has at least two receiving devices for the fastening of side wall elements of the drawer, which receiving devices are situated on opposite sides of the fastening element and can be adapted in a simple manner to different types of drawers. On the one hand, the receiving devices can fasten an individual side drawer wall element so that no gaps are formed in the area of the side wall element. On the other hand, between two side wall elements gaps can be formed on the receiving devices, which side wall elements both engage in such a receiving device for the fastening. In addition, an attachment can be mounted on the holding part in order to change the height of the side wall.

In a preferred embodiment of the invention, the receiving devices taper toward the outside, so that the receiving device opening has a smaller cross-section than a portion of the interior of the receiving device. This permits a clamping of the side wall elements into the receiving device in order to avoid their unintentional falling-out.

The holding part preferably has devices for mounting an attachment, such as several arms, between which a slot is formed. These devices permit an individual design of the side wall with respect to the height and the stability of the side wall. When the arms for fastening the attachment are arranged to be offset with respect to one another along the slot, the holding part can be produced of a plastic material simply by injection molding.

In another embodiment of the fastening arrangement, each holding part is provided with an attachment which lengthens the holding part parallel to a side wall. In this case, the attachment may be fitted into the holding part and have at its end situated opposite the holding part at least two receiving devices for fastening side wall elements which receiving devices are situated on opposite sides. This further development permits the universal use of side wall elements for a holding part without an attachment as well as for a holding part with an attachment.

A connection between the attachment and the receiving device which is easy to mount is obtained when each attachment has pins which each rest against an arm of the holding part. It is also possible to provide catch and snap-type connections for the fastening.

When each holding part has four arms which are arranged offset with respect to one another and each have a curved section, the attachment can be fitted on with a precise fit and will not tilt on the holding part. In addition, the curvature of the arms can be utilized for providing a profile section of the side wall with the required stability.

A more flexible design of the height of the side wall is permitted when the attachment has devices on its end facing away from the holding part which can be connected with another attachment.

In the following, the invention will be explained in detail with respect to the attached drawings by means of several embodiments. Additional feature of the invention will become apparent to those of ordinary skill in the art upon consideration of the following detailed description of preferred embodiments exemplifying the best mode of carrying out the invention as presently preceived.

DETAILED DESCRIPTION OF THE PREFERRED EMBODIMENTS

Figure 1:
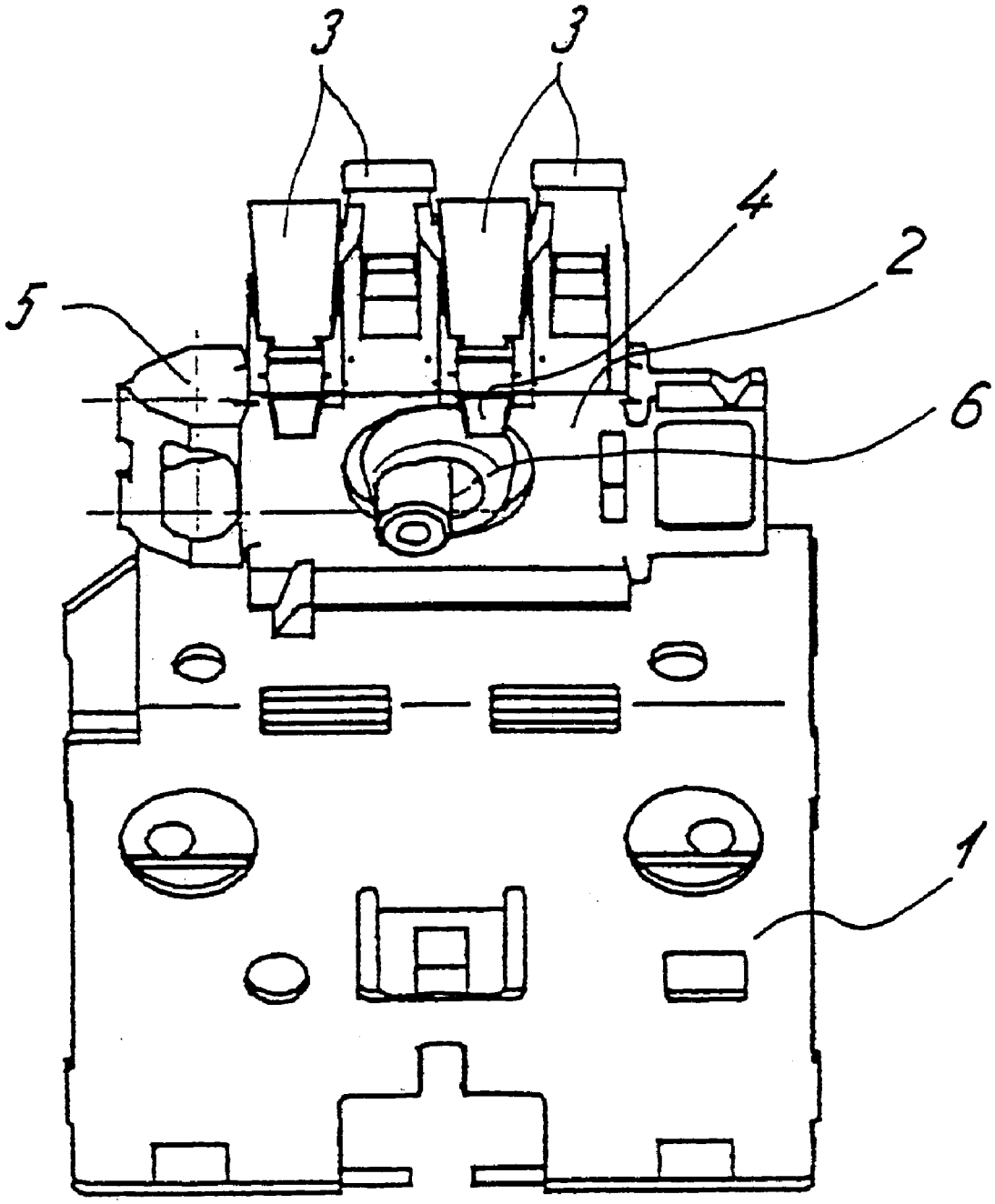
FIG. 1 is a perspective view of a first embodiment of a fastening arrangement according to the invention.

A fastening arrangement has a metal fastening element 1 which can be connected with a rail of a pull-out slide. A holding part 2 made of plastic material is cast to the fastening element 1 made of metal. The holding part 2 has several upward-extending arms 3 which have a curved section at their free end. In addition, several projections 4 are constructed on the holding part 2 and extend diagonally upward from the main body of the holding part 2. A receiving device having opening 50 (FIG. 6) is therefore formed between each arm 3 and the projection 4 situated underneath which expands from the exterior lateral opening between the arm 3 and projection 4 toward the interior to a wall of the holding part 2. The holding part 2 is provided with four arms 3 and projections 4, so that two receiving devices are formed on each side of the holding part 2.

Figure 2:
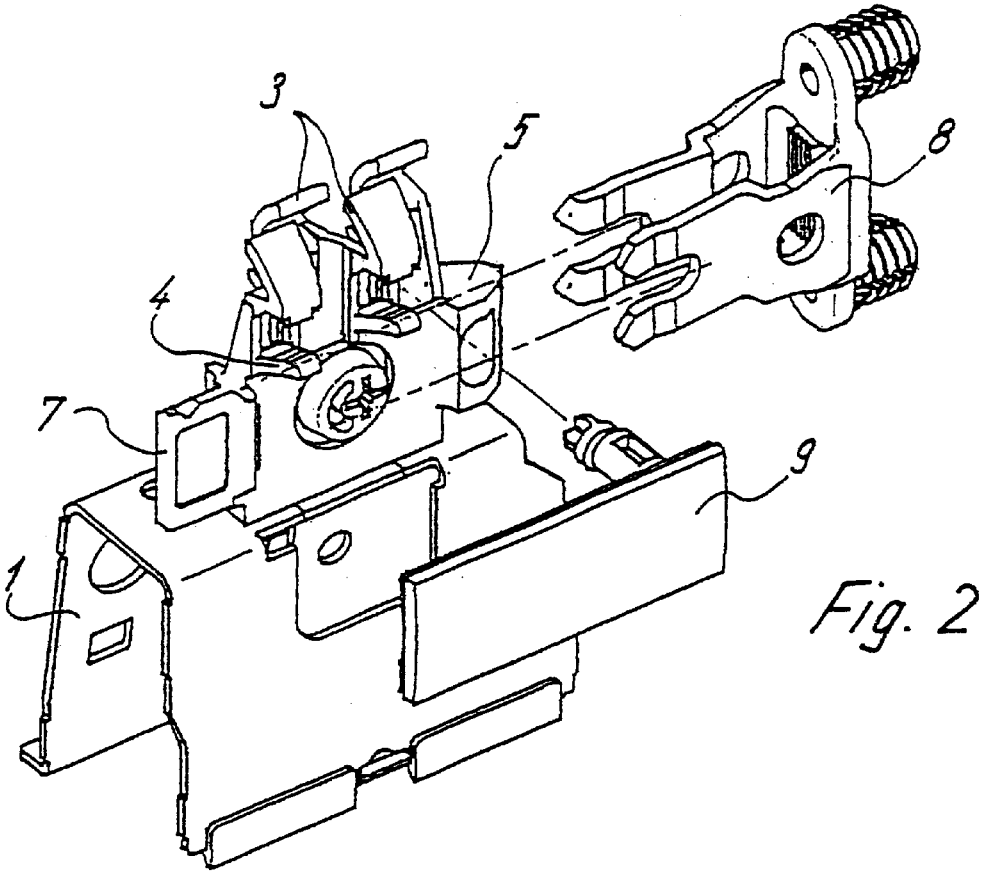
FIG. 2 is a perspective view of the fastening arrangement of FIG. 1 with additional connection elements.

For fastening a front panel of a drawer, the holding part 2 is provided with a head 5 and an eccentric device 6 by means of which a fastening part 8 can be adjusted and locked which can be connected with a front panel. An eccentric lever 9 is provided for rotating and locking of the eccentric device which eccentric sides in a slot on the end of the fastening. By actuation of lever 9, the eccentric, which rides in the fork of the fastening part, moves the fastener part, up, down or transversely away from the attachment 10. The head 5 has a projection at its outer end which meshes with a cavity rib indentations internally of the fastening part between its forked legs (see FIG. 2).

Figure 3:
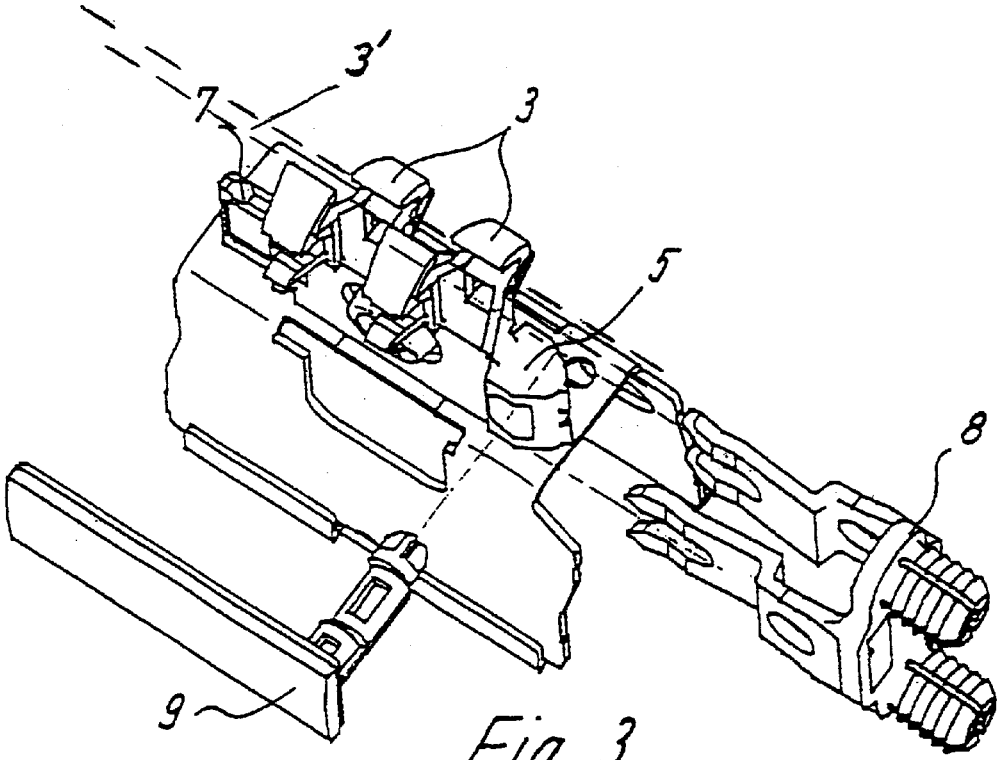
FIG. 3 is a perspective view of the fastening arrangement according to FIGS. 1 and 2.
Figure 4:
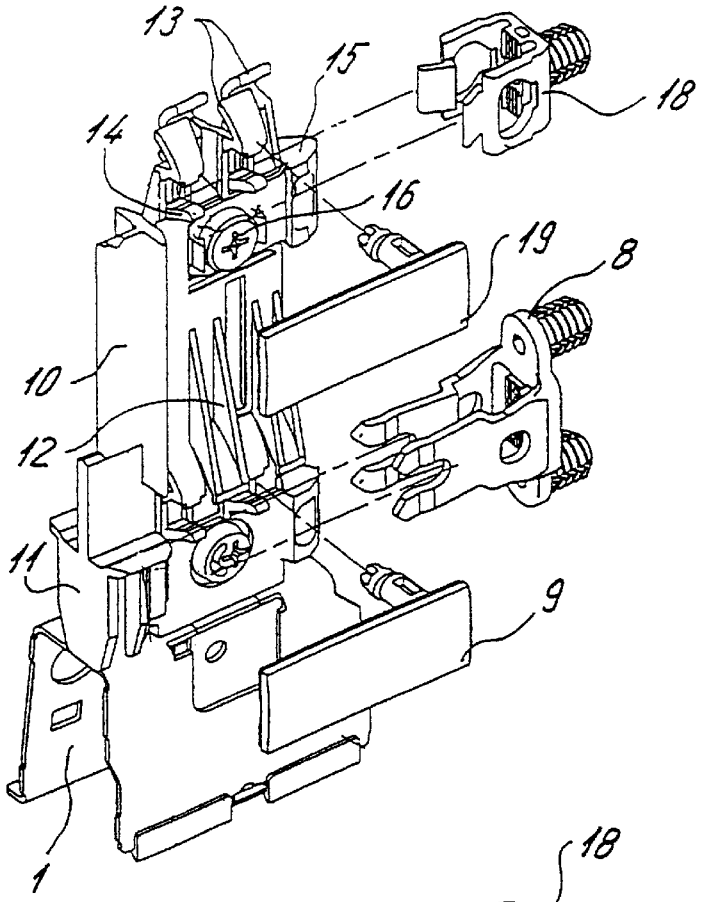
FIG. 4 is a perspective view of a fastening arrangement according to the invention having an attachment.
Figure 5:
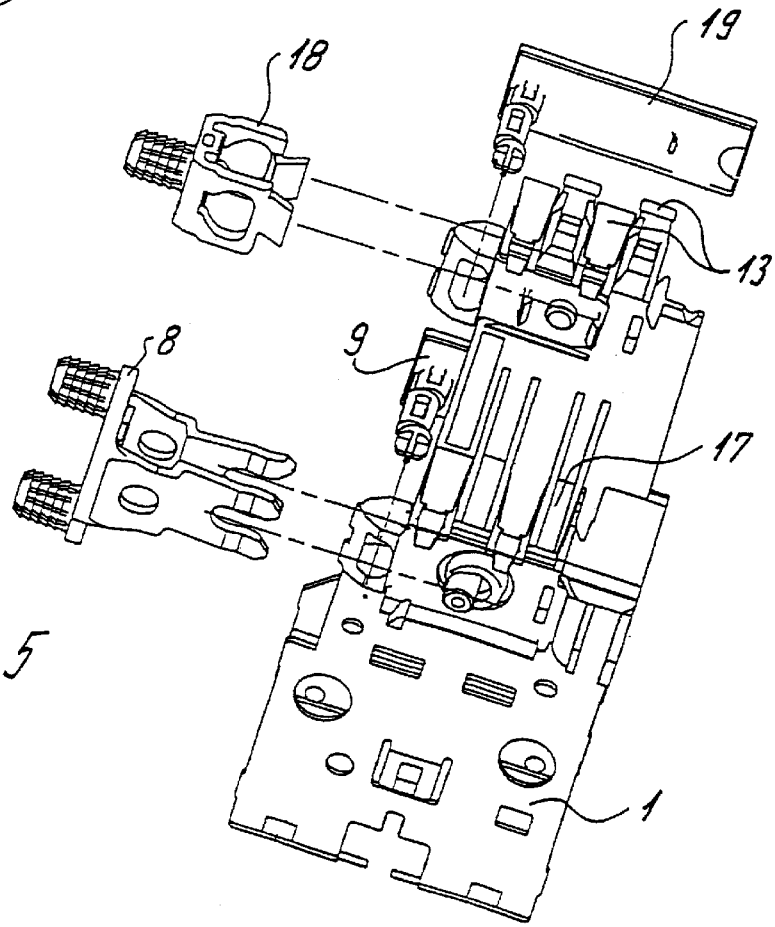
FIG. 5 is a perspective view of the fastening arrangement of FIG. 4 from the other side.

In FIGS. 4 and 5, an attachment 10 is fitted onto the holding part 2 on the fastening element 1. Pins 17 are provided for this purpose which each rest against an arm 3, a slot 3' (FIG. 3) being constructed between two diagonally opposite arms 3. In order to ensure a good stability of the fastening of the attachment 10, a groove formed in a lengthening 11 surrounds a web 7 of the holding part 2 in a form-locking manner. Reinforcing ribs 12 are arranged laterally on the attachment 10. In the lower area, these reinforcing ribs 12 can also be used as a rest for side wall elements. At the upper end of the attachment 10, arms 13 and projections 14 are constructed which form receiving devices between one another for fastening side wall elements. Like the holding part 2, the attachment 10 is equipped with a head 15 and an eccentric device 16 which are used for adjusting and locking a front panel by means of a connection part 18 and an eccentric lever 19.

The arms 13 are offset with respect to one another and form a vertically extending slot between one another in which another attachment 10 can engage in order to lengthen the fastening arrangement in the vertical direction. Laterally with respect to the arms 13, a web is constructed on the attachment 10 at which a lengthening 11 of another attachment can engage.

Figure 6:
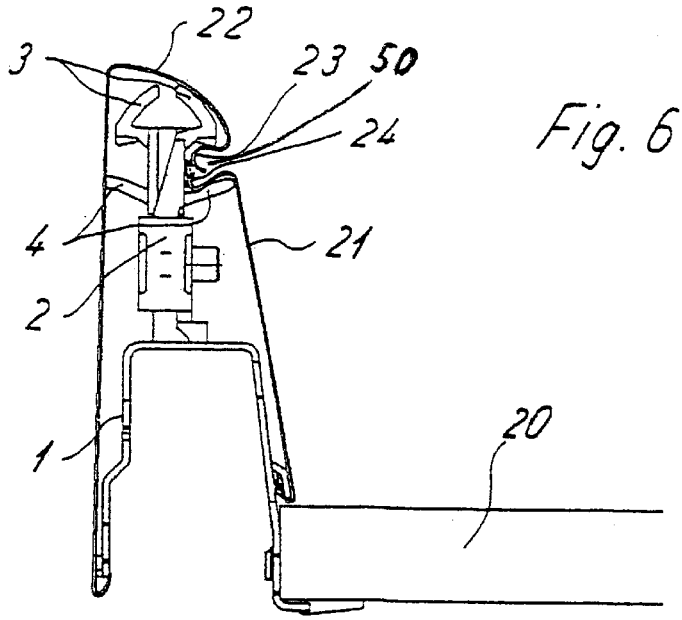
FIG. 6 is a sectional view of the fastening arrangement of FIG. 1 in the mounted condition.

FIG. 6 shows the fastening arrangement without the attachment in the mounted condition. A fastening element 1 is connected with a rail, which is not shown, of a pull-out slide. Above the fastening element 1, the holding part 2 is arranged which is provided with arms 3 and projections 4 which each form a receiving device. An interior side wall element 21 and an exterior side wall element 22 engage in the interior receiving devices. The side wall elements 21 and 22 have corresponding curvatures which ensure a firm contact in the receiving device formed by the arms 3 and the projections 4. The lower edge of the interior side wall element 21 rests on a sliding bottom 20. The exterior side wall element 22 surrounds the fastening arrangement and, in the lower area, ends approximately with the fastening element 1, in which case it rests laterally against the fastening element 1 and the outward-protruding projections 4. In the upper area, the exterior side wall element 22 is supported by the arms 3 situated on the side of the sliding bottom 20.

Figure 7:
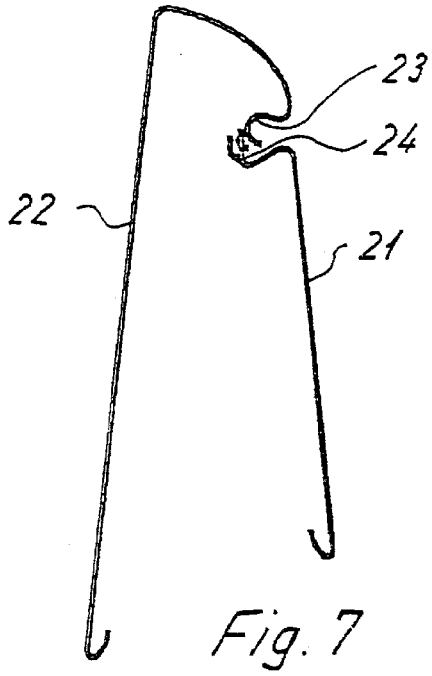
FIG. 7 is a cross-sectional view of the side wall elements mounted in FIG. 6.

FIG. 7 shows the interior side wall element 21 and the exterior side wall element 22 without the fastening arrangement. The interior side wall element 21 has a curvature 24 which rests in the receiving device formed by the arms 3 and the projections 4. The exterior side wall element 22 also has a curvature 23 which clamps the curvature 24 of the interior side wall element 21 into the receiving device in the manner of a catch device.

Figure 8:
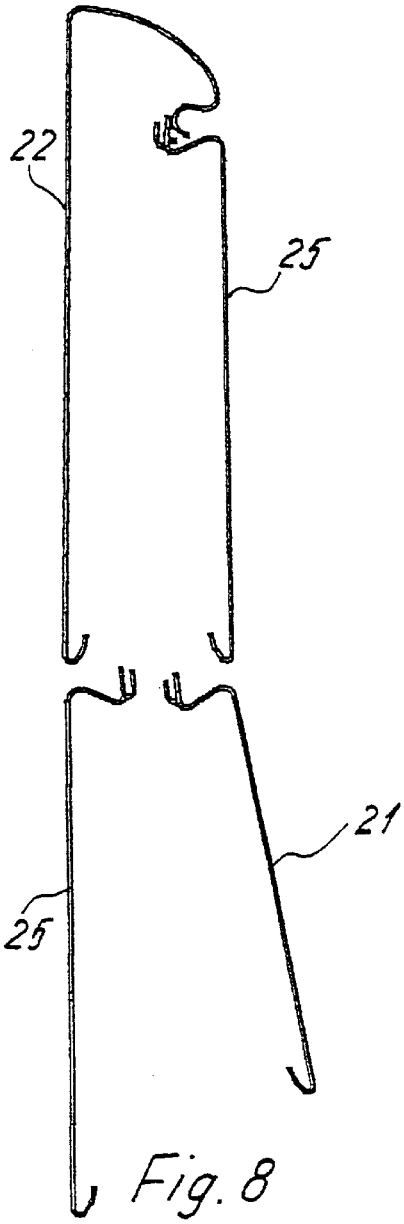
FIG. 8 is a cross-sectional view of side wall elements for a fastening arrangement with an attachment.

FIG. 8 shows side wall elements which can be used in connection with a fastening arrangement with an attachment 10. The interior side wall element 21 and the exterior side wall element 22 are constructed as in the embodiment according to FIG. 6. Additionally, profile elements 25 form a side wall together with side wall elements 21 and 22. A profile 25 is arranged on the interior side of the drawer between the interior side wall element 21 and the exterior side wall element 22. The connection in the receiving devices with the profile 25 occurs in the same manner between the interior side wall element 21 and the exterior side wall element 22, as shown in FIG. 7.

Figure 9:
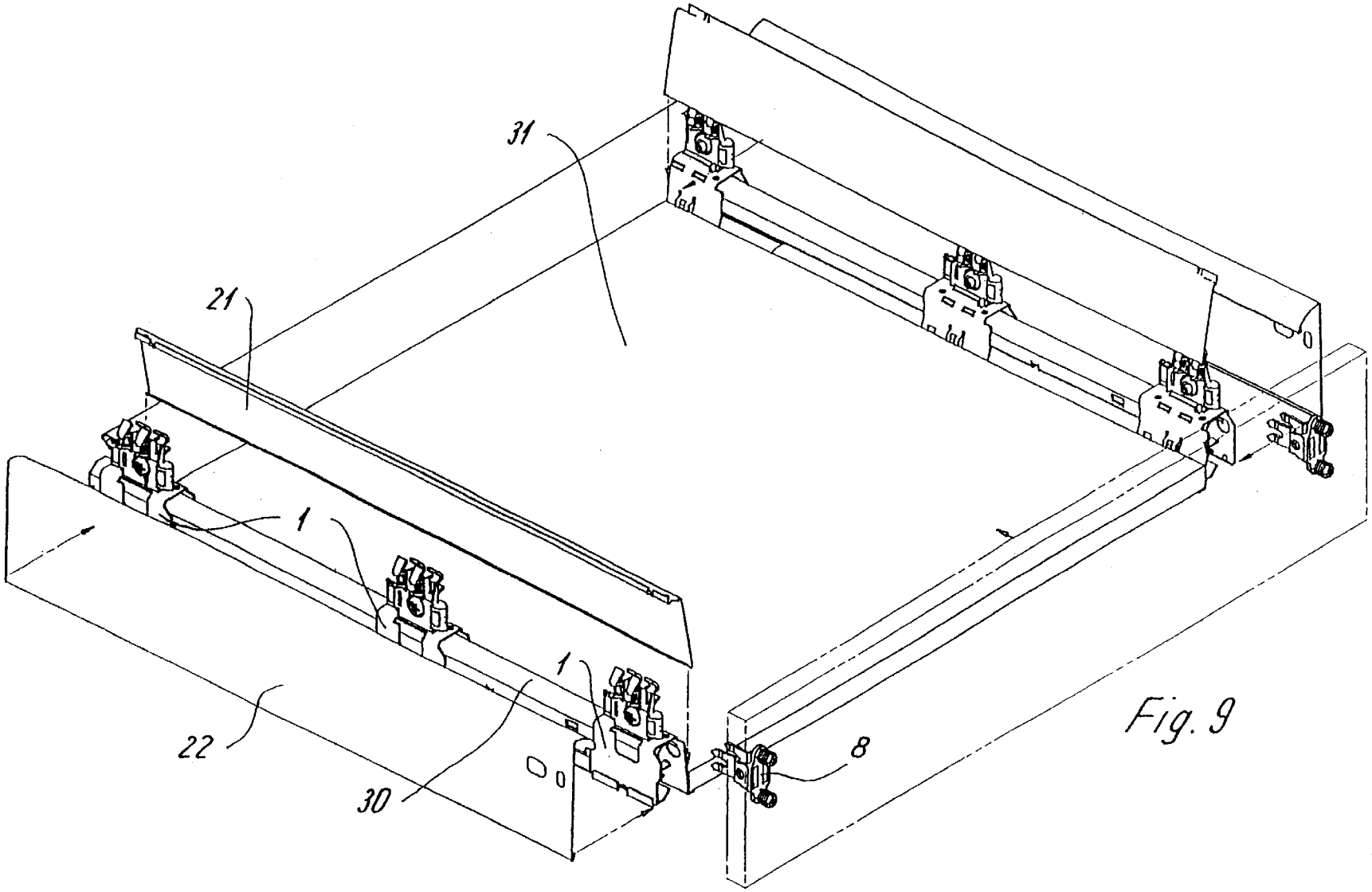
FIG. 9 is a perspective view of a drawer during the mounting.

FIG. 9 shows a drawer with the fastening arrangement according to the invention. Three fastening elements 1 are mounted on a rail 30 of a pull-out slide and are, for example, riveted to this rail 30. Using pins (not shown), the fastening elements 1 are connected with a sliding drawer bottom 31 so that the sliding drawer bottom 31 can be moved together with the fastening elements 1 A front drawer panel is mounted on the front side of the drawer connection parts 8 on the two frontal fastening elements 1.

So that the drawer has an aesthetic appearance and is easy to clean, an interior side wall element 21 forms an interior side surface of the drawer. On the exterior side of the drawer, an exterior side wall element 22 shown in FIGS. 6 and 7, is connected with the interior side wall element 21, so that only a slot is inside the drawer.

Figure 10:
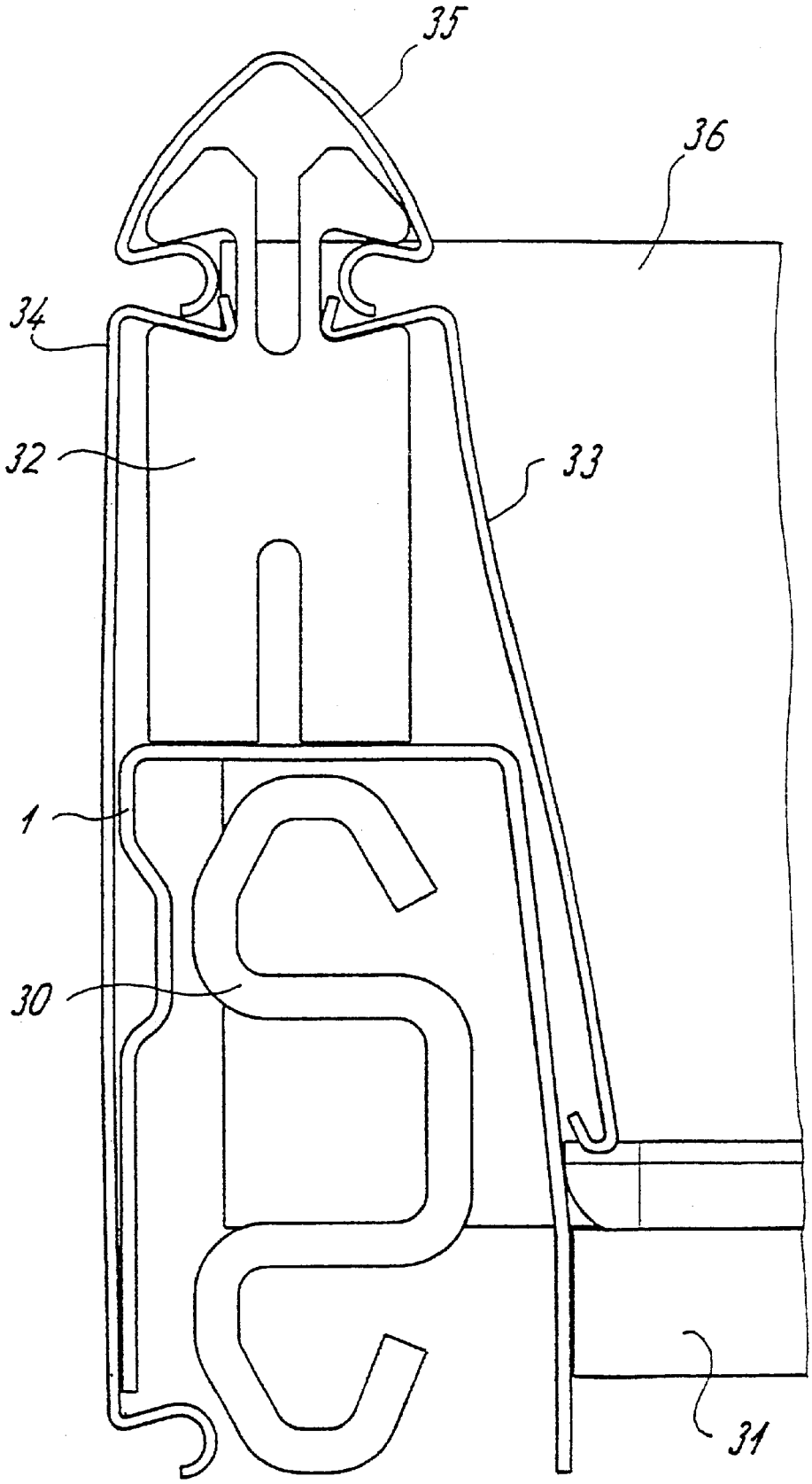
FIG. 10 is a cross-sectional view of a second embodiment of a fastening arrangement.

In the embodiment according to FIG. 10, a sliding drawer bottom 31 is connected with a fastening element 1 which is mounted on a rail 30 of a pull-out slide. On the fastening element 1, a holding part 32 is mounted in whose upper area two lateral receiving devices are constructed. Two fastening elements 1 are provided along the rail 30 of the pull-out slide. The interior side of the drawer is bounded by an interior side wall 33 which rests on an attachment of the sliding bottom 31 and engages in the upper area in the interior receiving device. The interior side wall element 33 is held by a profile edge 35 which engage on both sides into the formed receiving devices. As a result, an exterior side wall element 34 is clamped to the holding part 32 on the exterior side. The drawer is also bounded by a rear wall 36.

Figure 11:
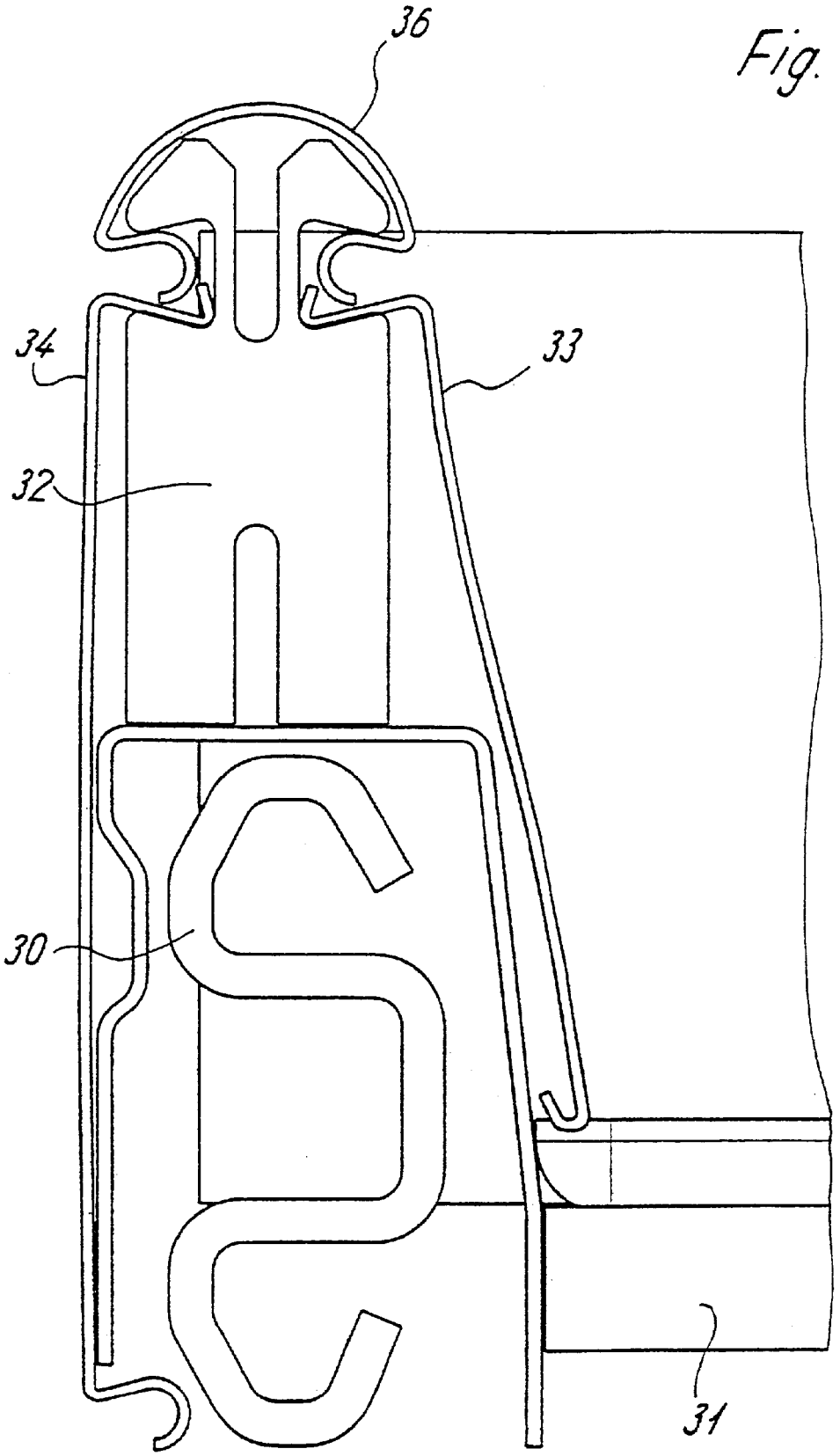
FIG. 11 is a view of a modification of the fastening arrangement of FIG. 10.

In the embodiment illustrated in FIG. 11, the fastening arrangement is constructed as in the embodiment according to FIG. 10. A curved profile edge 36 is provided in the upper area, which provides the drawer with a rounded-off appearance.

Figure 12:
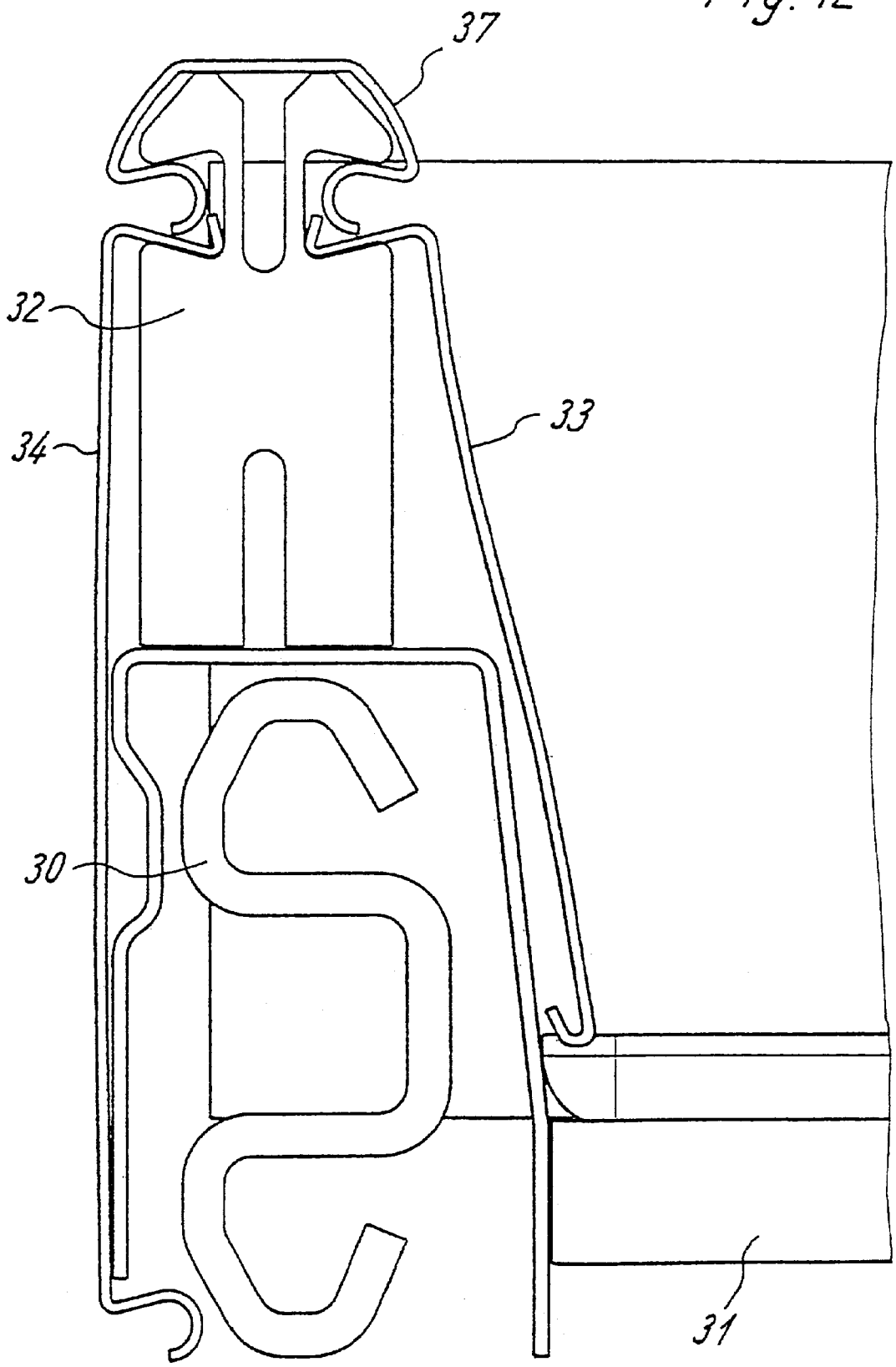
FIG. 12 is a view of a modification of the fastening arrangement of FIG. 10.

FIG. 12 shows another modification of a drawer according to FIG. 10, in which an upper profile edge 37 reaches around the holding part 32 to form a flat surface. The surface can be utilized as a rolling or sliding surface for file elements.

Figure 13:
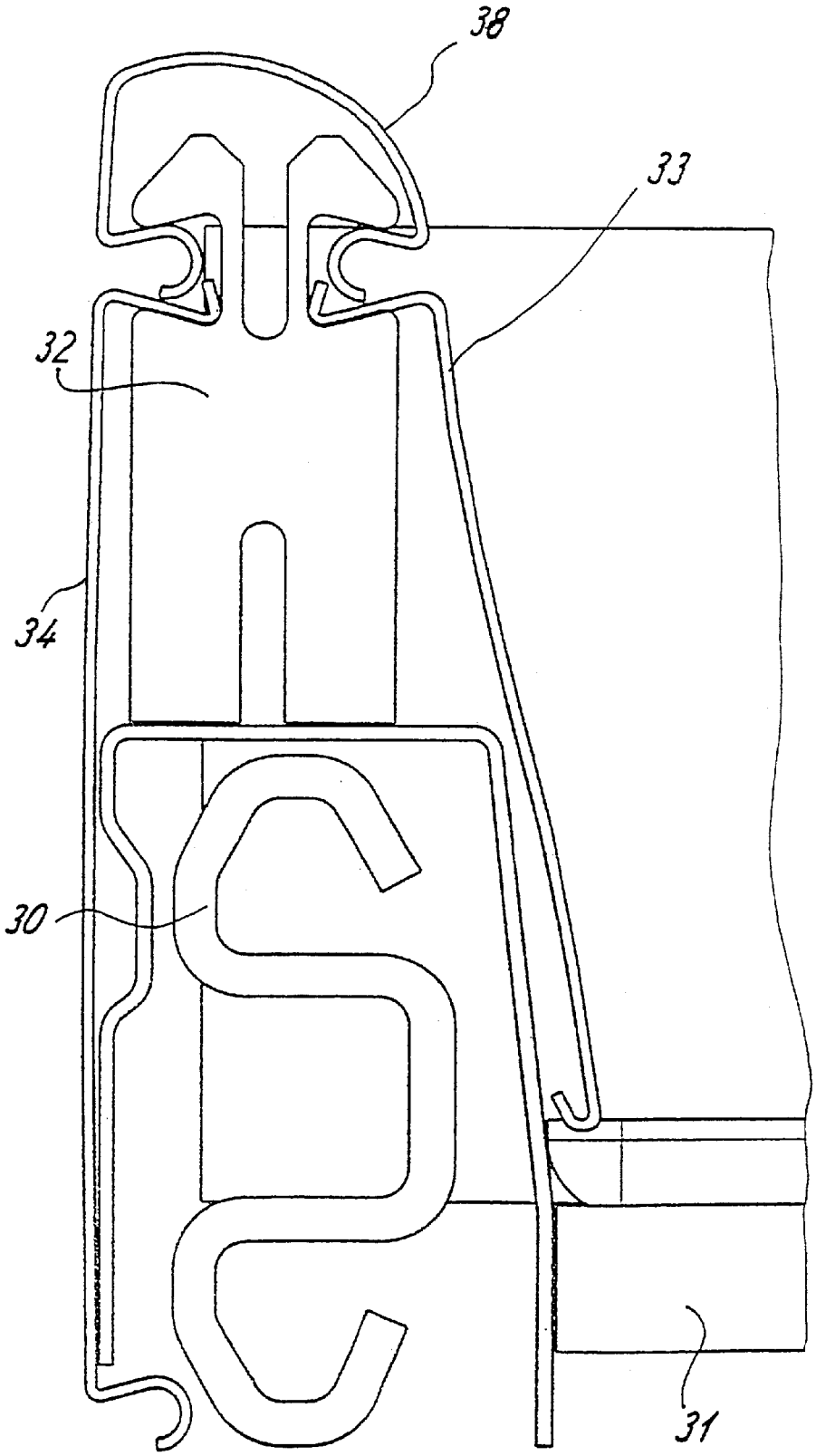
FIG. 13 is a view of a modification of the fastening arrangement of FIG. 10.
Figure 14:
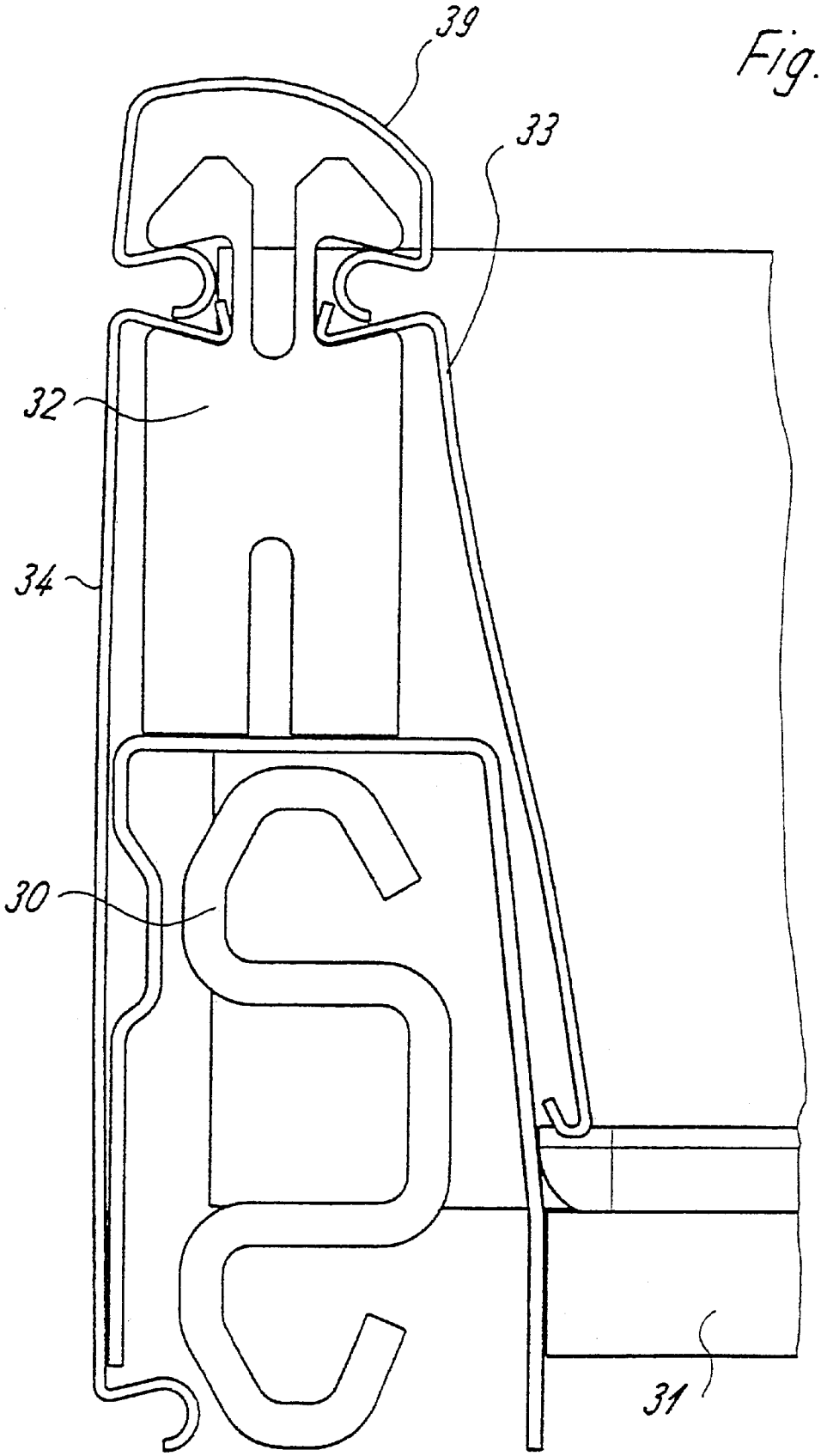
FIG. 14 is a view of a modification of the fastening arrangement of FIG. 10.

In FIG. 13, an asymmetrical upper profile edge 38 provides the drawer with a unique appearance. The embodiment according to FIG. 14 has a similar asymmetrical profile edge 39 clamped to the holding part 32.

Figure 15:
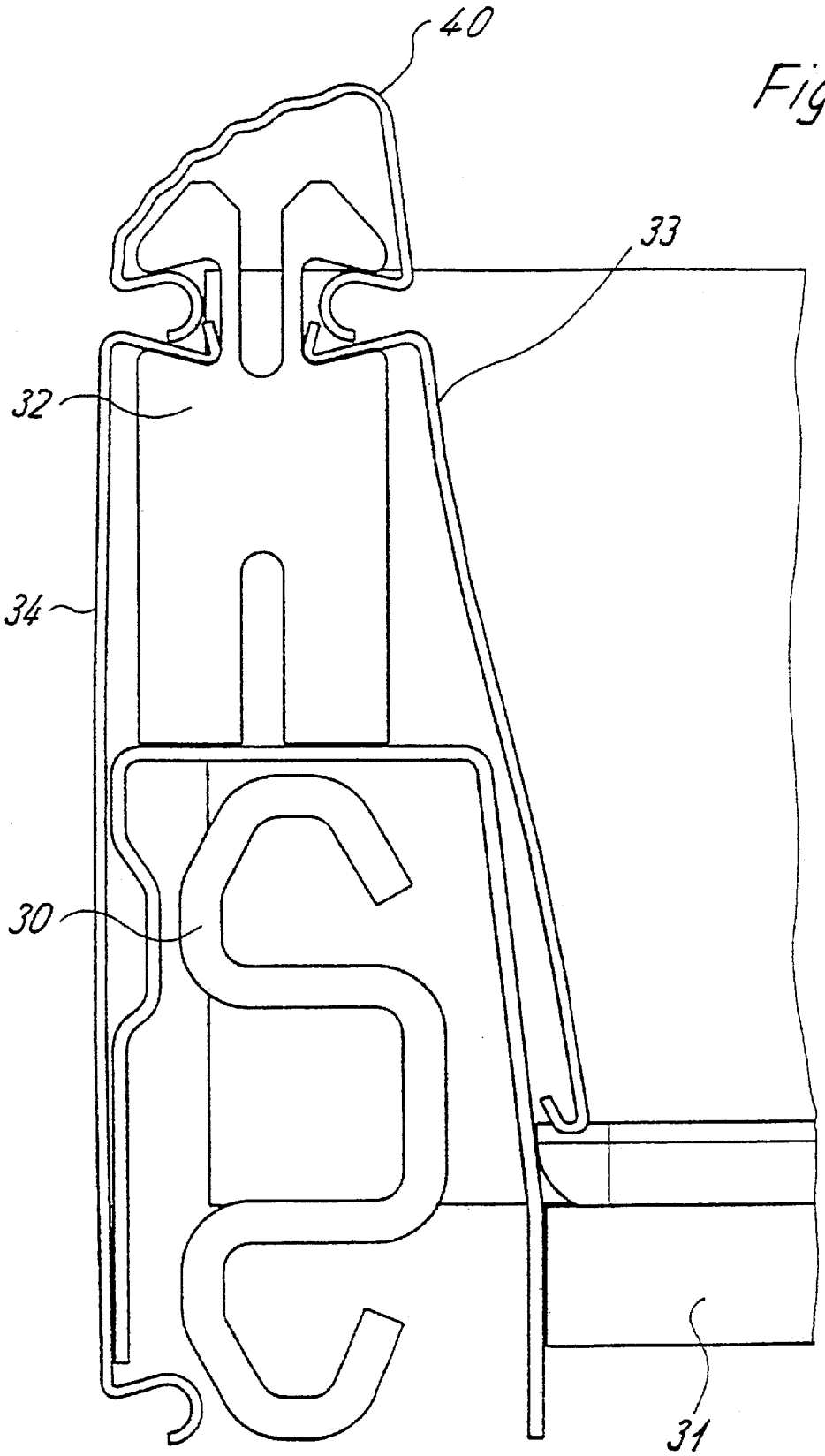
FIG. 15 is a view of a modification of the fastening arrangement of FIG. 10.

An additional modification of the upper edge is illustrated in FIG. 15, in which the profile edge 40 is provided with flutings which can be used as a reinforcement and give the drawer an elegant appearance.

Figure 16:
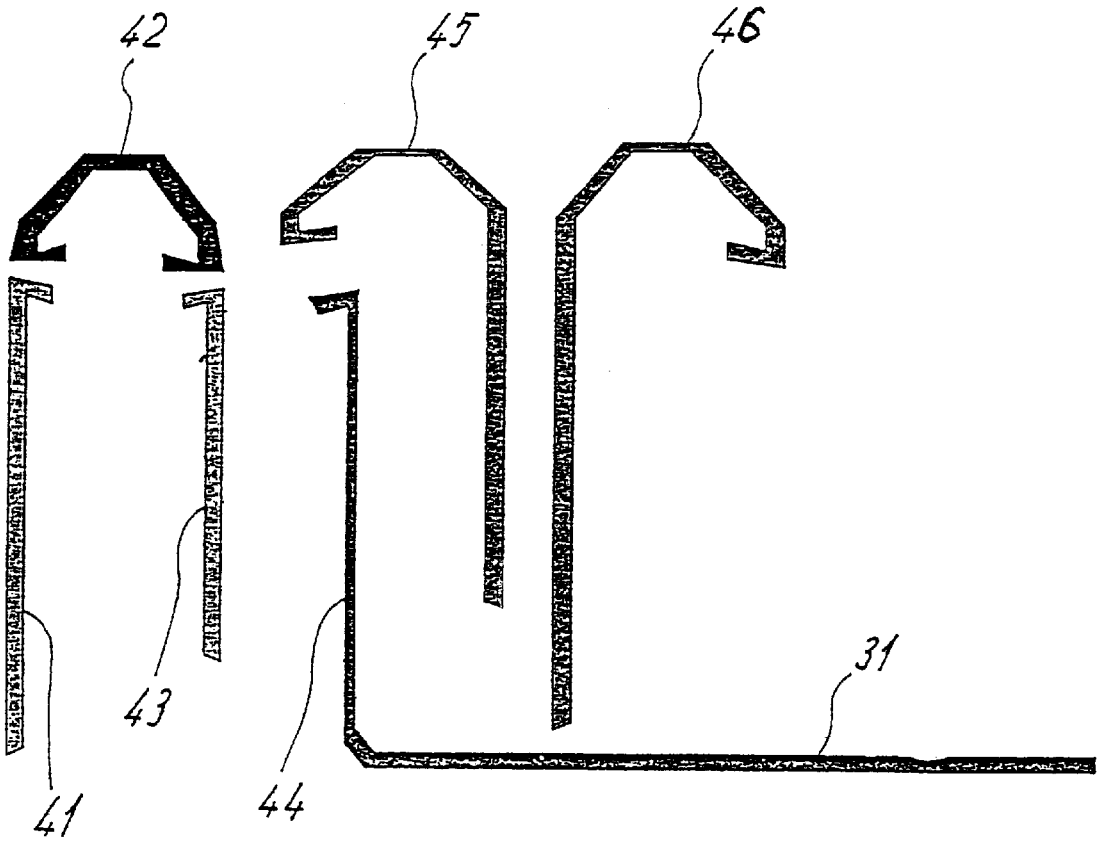
FIG. 16 is a cross-sectional view of several side wall elements.

FIG. 16 shows additional side wall elements 41 and 43 which can be assembled with a profile edge 42 or a side wall element 46 and 45 with an integrated upper profile edge. It is also possible to shape a side wall element 44 integrally with the sliding bottom 31. FIGS. 17A to 17D show the respective side wall elements in the mounted condition. By using a wall element 40 with an integrated upper profile edge, a gap formation is avoided on the exterior side. The use of a sliding bottom 31 with an integrated side wall element 44 (FIG. 17C) permits the construction of an edge without a gap.

Figures 17A, 17B, 17C, 17D:
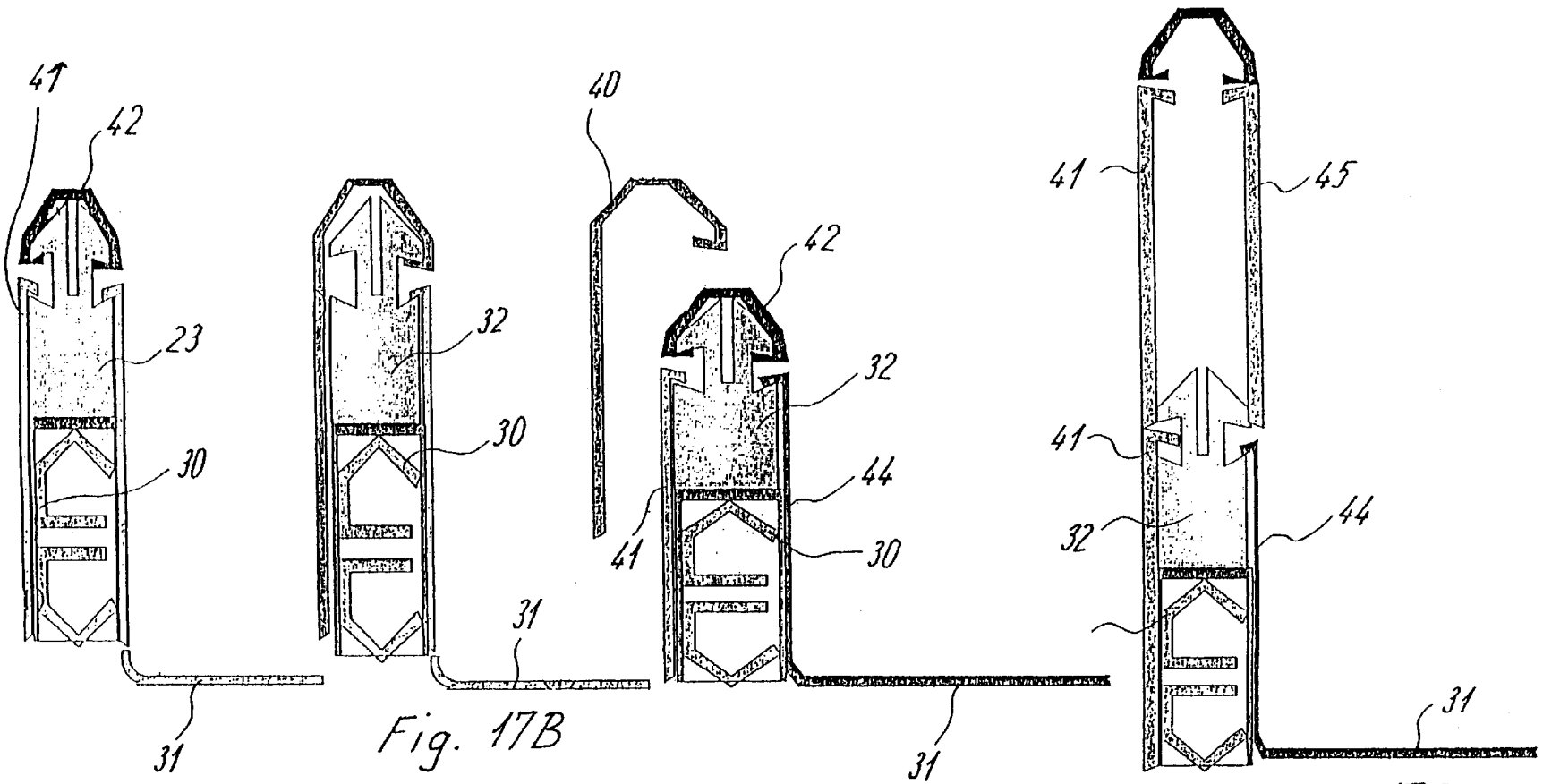
FIGS. 17A–17D are several views of the side wall elements of FIG. 16 in the mounted condition.

FIG. 17D shows an embodiment for the arrangement of side wall elements 41, 44 and 45 which are mounted on a fastening arrangement with an attachment. On the exterior side, two identically constructed side wall elements 41 are fastened which are fastened on a lower holding part 32 and the attachment 10. On the interior side, a side wall element 45 is mounted which closes off tightly with a profile edge 42. In the lower area, a side wall element 44 is constructed integrally with the sliding bottom 31.

Figure 18:
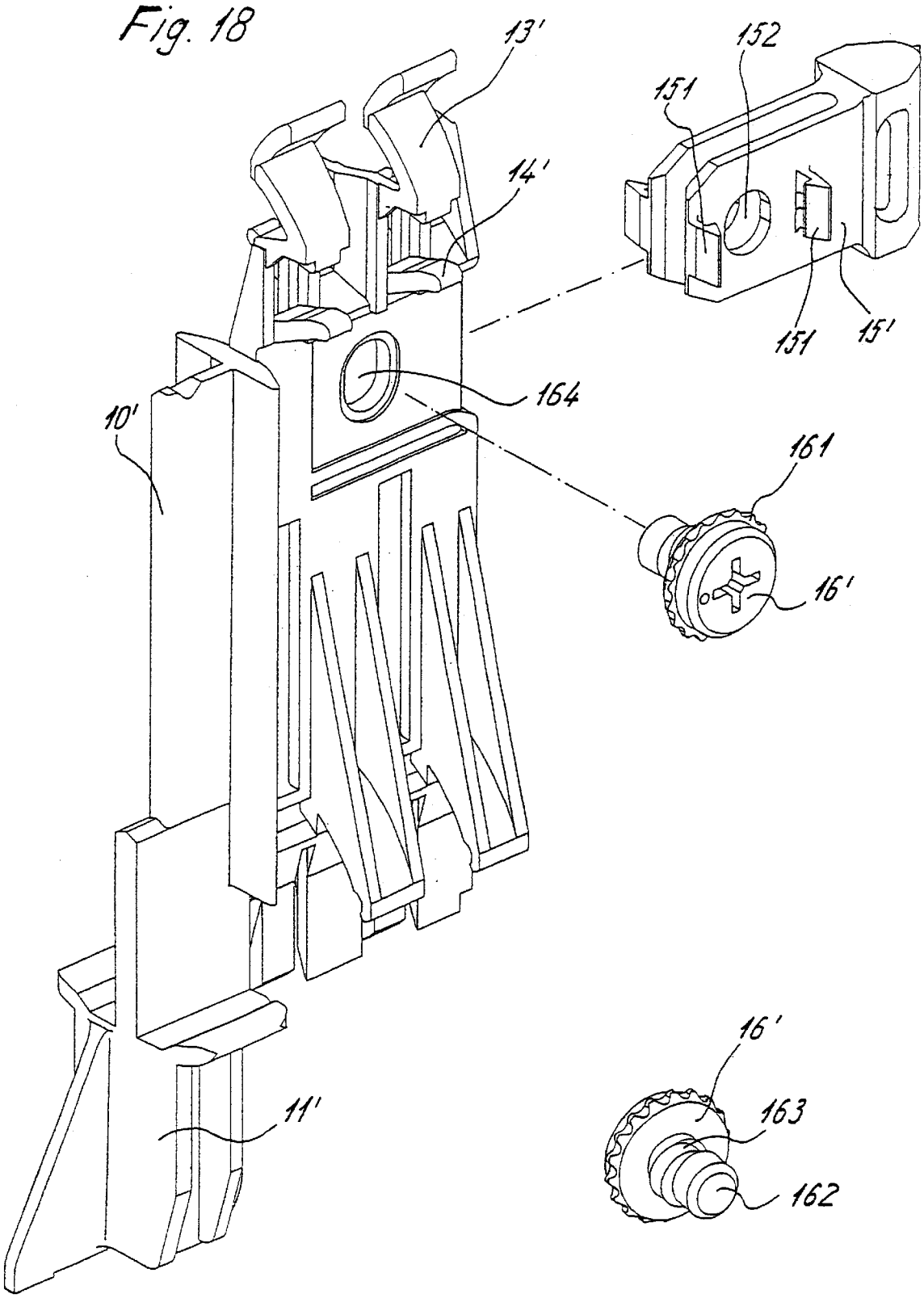
FIG. 18 is a perspective view of another attachment for a fastening arrangement according to the invention.

FIG. 18 shows another embodiment of an attachment 10'. The attachment 10' has a lengthening 11' with a groove which can form-lockingly reach around a web 7 of the holding part 2. Reinforcing ribs 12' are arranged on both sides of the attachment 10'. On the upper end of the attachment 10', arms 13' and projections 14' are constructed which form receiving devices between one another for fastening side wall elements. In addition, the attachment 10' can be connected with a head 15' which can be adjusted by means of an eccentric device 16'. By way of a fastening part 8, the head 15' can be connected with a front panel and has two projections 151 which surround an opening 152. When the head 15' is fitted onto the attachment 10', the opening 152 is aligned with an opening 164 formed at the attachment 10'. For adjusting the head 15', an eccentric screw 16' is provided which has an axle 162 and an eccentric section 163. In addition, a fluting 161 is provided which interacts with the projections 151 of the head 15', so that a step-by-step rotation is possible and the head 15' is adjusted upward or downward step-by-step by the rotation of the eccentric screw 16'.

According to the illustrated embodiments, the invention may provide different side wall elements for a drawer, so that different drawers can be formed by the same fastening arrangement. The drawers can vary in their height, when one or several attachments 10 are provided, as well as in their design, as shown in FIGS. 10 to 15. This permits an extremely flexible design of the side wall elements without any increase of the cost for the fastening arrangement as a result of the plurality of product lines. Because the side wall elements partly have a symmetrical construction, they can be used for the right as well as the left side of the drawer. The universal use of different side wall elements at different positions of a drawer reduces the manufacturing and storage cost.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A fastening arrangement for side walls of drawers, the arrangement comprising:

an elongated rail of a pull-out slide;

several fastening elements for connection to the rail of a pull-out slide;

each fastening element having a holding part extending essentially parallel to the rail;

at least two receiving devices formed as openings on opposite sides of each holding part; and, wherein the receiving device openings are for fastening side wall elements to the holding parts.

2. A fastening arrangement according to claim 1 wherein the receiving devices taper outwardly to form a receiving opening which increases in cross-sectional area from the exterior to an interior of the receiving device.

3. A fastening arrangement according to claim 1, wherein at least one side wall element is fastened to a holding part by receiving devices.

4. A fastening arrangement for side walls of drawers, the arrangement comprising:

an elongated rail of a pull-out slide;

several fastening elements for connection to the rail of a pull-out slide;

each fastening element having a holding part constructed to receive and mount an attachment configured to form a slot therebetween and extending essentially parallel to the rail;

at least two receiving devices on opposite sides of each holding part; and, wherein the receiving devices are for fastening side wall elements to the holding parts.

5. A fastening arrangement according to claim 4, wherein the receiving devices are arms displaced from one another along the slot.

6. A fastening arrangement according to claim 4, wherein at least one side wall element is fastened to a holding part by receiving devices.

7. A fastening arrangement for side walls of drawers, the arrangement comprising:

an elongated rail of a pull-out slide;

several fastening elements for connection to the rail of a pull-out slide;

each fastening element having a holding part extending essentially parallel to the rail;

at least two receiving devices on opposite sides of each holding part;

an attachment which increases the height of the holding part in a plane parallel to a side wall of the device; and, wherein the receiving devices are for fastening side wall elements to the holding parts.

8. A fastening arrangement according to claim 7, wherein the attachment is provided with receiving devices positioned on opposite sides of the attachment for forming a holding part which fastens the side of the drawer wall to the attachment.

9. A fastening arrangement according to claim 8, wherein the attachment is adapted for connecting an additional attachment to the fastening arrangement.

10. A fastening arrangement according to claim 7, wherein each attachment is provided with a pin resting against a receiving device of the holding part.

11. A fastening arrangement according to claim 7, wherein at least one side wall element is fastened to a holding part by receiving devices.

12. A fastening arrangement for side walls of drawers, the arrangement comprising:

an elongated rail of a pull-out slide;

several fastening elements for connection to the rail of a pull-out slide;

each fastening element having a holding part extending essentially parallel to the rail;

at least two receiving devices on opposite sides of each holding part, each holding part for forming four arms displaced from one another, each arm having a curved section; and, wherein the receiving devices are for fastening side wall elements to the holding parts.

13. A fastening arrangement according to claim 12, wherein at least one side wall element is fastened to a holding part by receiving devices.

* * * * *